US006988298B2

(12) United States Patent
Ternasky et al.

(10) Patent No.: US 6,988,298 B2
(45) Date of Patent: Jan. 24, 2006

(54) SHOELACE RETAINER

(76) Inventors: Mitchell L. Ternasky, 7022 Bromont Pl., Canal Winchester, OH (US) 43110; P. Christine Ternasky, 7022 Bromont Pl., Canal Winchester, OH (US) 43110

( * ) Notice: Subject to any disclaimer, the term of this patent is extended or adjusted under 35 U.S.C. 154(b) by 0 days.

(21) Appl. No.: 10/877,150

(22) Filed: Jun. 24, 2004

(65) Prior Publication Data

US 2005/0283956 A1 Dec. 29, 2005

(51) Int. Cl.
*A43C 7/00* (2006.01)

(52) U.S. Cl. ..... 24/712.3; 24/712.2; 24/306; 36/136

(58) Field of Classification Search ..... None
See application file for complete search history.

(56) References Cited

U.S. PATENT DOCUMENTS

| | | | | | |
|---|---|---|---|---|---|
| 4,291,439 | A | | 9/1981 | Riti | |
| D270,779 | S | | 10/1983 | Steinberg | |
| 4,428,101 | A | | 1/1984 | Harkavy | |
| 4,630,383 | A | * | 12/1986 | Gamm | 36/136 |
| 4,715,094 | A | | 12/1987 | Herdman | |
| 4,766,682 | A | | 8/1988 | Malloy | |
| 4,790,048 | A | | 12/1988 | Arnt | |
| 4,805,270 | A | | 2/1989 | Kimbrough | |
| 4,879,787 | A | * | 11/1989 | Walls | 24/712.2 |
| 4,949,437 | A | * | 8/1990 | Anderson | 24/712.2 |
| 4,969,242 | A | | 11/1990 | Carlton, Sr. | |
| 4,999,888 | A | | 3/1991 | Miller | |
| 5,022,127 | A | | 6/1991 | Ang | |
| 5,027,482 | A | | 7/1991 | Torppey | |
| 5,029,371 | A | | 7/1991 | Rosenblood | |
| 5,042,119 | A | | 8/1991 | Williams | |
| 5,097,573 | A | | 3/1992 | Gimeno | |
| 5,119,539 | A | | 6/1992 | Curry | |
| 5,165,190 | A | | 11/1992 | Smyth | |
| 5,170,573 | A | | 12/1992 | Clinch | |
| 5,351,370 | A | | 10/1994 | Fields | |
| 5,402,589 | A | | 4/1995 | Lubrani | |
| 5,421,106 | A | * | 6/1995 | Emrick | 36/136 |
| 5,459,947 | A | | 10/1995 | Lasher | |
| 5,566,477 | A | | 10/1996 | Mathis | |
| 5,649,342 | A | | 7/1997 | D'Andrade | |
| 5,671,517 | A | * | 9/1997 | Gourley | 24/712.1 |
| 5,701,688 | A | | 12/1997 | Crowley | |
| 5,718,021 | A | | 2/1998 | Tatum | |
| 5,778,500 | A | | 7/1998 | Illingworth | |

(Continued)

*Primary Examiner*—Robert J. Sandy
(74) *Attorney, Agent, or Firm*—Porter, Wright, Morris & Arthur, LLP

(57) ABSTRACT

A footwear lace retainer includes a first fabric sheet having a pair of spaced-apart openings for passage of the lace therethrough and a second fabric sheet secured to the first fabric sheet to form a pocket sized and shaped for receiving ends of the lace therein and having an open end facing toward the openings. A portion of the first fabric sheet forms a closure selectively foldable between a closing position wherein the open end of the pocket is closed and an opening position wherein the open end of the pocket is open. The openings are located between a fold line of the first fabric sheet and the open end of the pocket. A hook and loop fastener releasably secures the closure in the closing position. An attachment on the first fabric sheet opposite the pocket secures the first fabric sheet to the lace.

19 Claims, 3 Drawing Sheets

U.S. PATENT DOCUMENTS

| | | | | |
|---|---|---|---|---|
| 5,903,959 | A | 5/1999 | Leonardi | |
| 5,913,483 | A | 6/1999 | Polk | |
| 5,918,352 | A | 7/1999 | Galbreath | |
| 5,979,028 | A | 11/1999 | Hicks | |
| 6,000,111 | A | 12/1999 | Deskins et al. | |
| 6,240,607 | B1 | 6/2001 | McCrary | |
| 6,338,186 | B1 | 1/2002 | Kleinmann | |
| D453,413 | S | 2/2002 | Tsujino | |
| 6,449,881 | B1 * | 9/2002 | Assaf et al. | 36/136 |
| 6,601,323 | B2 | 8/2003 | Tsujino | |

* cited by examiner

SHOELACE RETAINER

CROSS-REFERENCE TO RELATED APPLICATIONS

Not Applicable

STATEMENT REGARDING FEDERALLY SPONSORED RESEARCH

Not Applicable

REFERENCE TO MICROFICHE APPENDIX

Not Applicable

FIELD OF THE INVENTION

The present invention generally relates to footwear and, more particularly, to devices and methods of securing, concealing and containing ends of footwear laces so that they remain secured and free of inadvertent snagging on foreign objects.

BACKGROUND OF THE INVENTION

Anyone who has ever worn laced footwear has experienced the problem of the laces inadvertently becoming untied. This is most common when the wearer ties the laces in a bow knot. When this occurs, the laces must be retied which can be inconvenient and an annoyance if it occurs frequently. Untied laces can also be dangerous because they can be stepped on by the wearer or another person or caught on a foreign object causing the wearer to trip. This is particularly a problem for athletes in sporting activities such as, for example, soccer.

There have been many attempts to solve this problem. Typically, a device is provided which attempt to retain the laces in a tied condition. Unfortunately, these devices are not very effective at retaining the laces in a tied condition and/or are not sufficiently pliable to be safely used in sporting activities. Accordingly, there is a need in the art for an improved device for securing, concealing and containing ends of footwear laces which is versatile, convenient, effective, and/or safe for use in sporting events.

SUMMARY OF THE INVENTION

The present invention provides a footwear lace retainer which overcomes at least some of the above-noted problems of the related art. According to the present invention, a footwear lace retainer comprises, in combination, a first wall having at least one opening for passage of the lace therethrough and a second wall operatively connected to the first wall to form a pocket sized and shaped for receiving ends of the lace therein and having an open end facing toward the opening. A closure is selectively movable between a closing position wherein the open end of the pocket is closed with the ends of the lace within the pocket and an opening position wherein the open end of the pocket is open. A fastener releasably secures the closure in the closing position.

According to another aspect of the present invention, a footwear lace retainer comprises, in combination, a first fabric sheet having at least one opening for passage of the lace therethrough and a second fabric sheet secured to the first fabric sheet to form a pocket sized and shaped for receiving ends of the lace therein and having an open end facing toward the opening. A portion of the first fabric sheet forms a closure selectively foldable between a closing position wherein the open end of the pocket is closed with the ends of the lace within the pocket and an opening position wherein the open end of the pocket is open. A fastener releasably secures the closure in the closing position.

According to yet another aspect of the present invention, a footwear lace retainer comprises, in combination, a first fabric sheet having a pair of spaced-apart openings for passage of the lace therethrough and a second fabric sheet secured to the first fabric sheet to form a pocket sized and shaped for receiving ends of the lace therein and having an open end facing toward the openings. A portion of the first fabric sheet forms a closure selectively foldable between a closing position wherein the open end of the pocket is closed with the ends of the lace within the pocket and an opening position wherein the open end of the pocket is open. The openings are located between a fold line of the first fabric sheet and the open end of the pocket. A hook and loop fastener releasably secures the closure in the closing position. An attachment on the first fabric sheet opposite the pocket secures the first fabric sheet to the lace.

From the foregoing disclosure and the following more detailed description of various preferred embodiments it will be apparent to those skilled in the art that the present invention provides a significant advance in the technology and art of footwear lace retainers. Particularly significant in this regard is the potential the invention affords for providing a high quality, reliable, versatile, convenient and easy to use, low cost device which is pliable enough to be used in sporting events. Additional features and advantages of various preferred embodiments will be better understood in view of the detailed description provided below.

BRIEF DESCRIPTION OF THE DRAWINGS

These and further features of the present invention will be apparent with reference to the following description and drawing, wherein.

Figure 4:
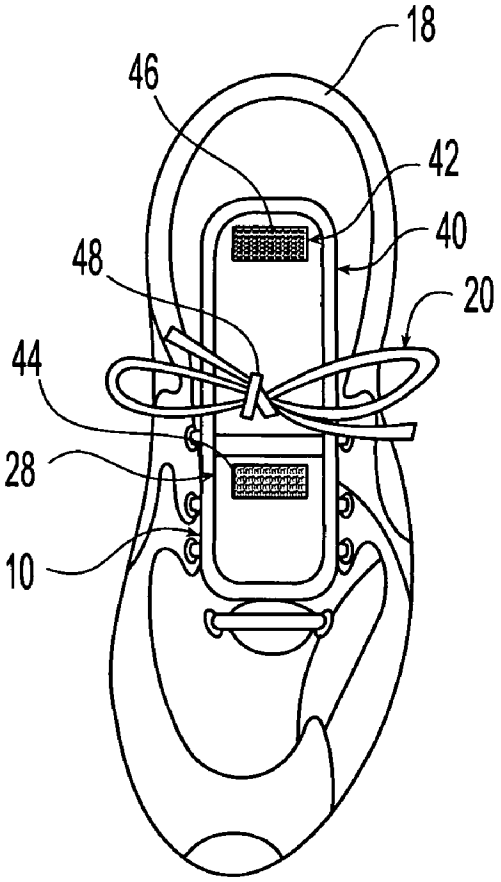
FIG. 4 is a top view showing the footwear lace retainer of FIGS. 1 to 3 in a partially installed condition wherein the lace is tied in a bow knot.

It should be understood that the appended drawings are not necessarily to scale, presenting a somewhat simplified representation of various preferred features illustrative of the basic principles of the invention. The specific design features of a footwear lace retainer as disclosed herein, including, for example, specific dimensions will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the shoelace retainer illustrated in the drawings. In general, up or upward refers to an outward direction out the plane of the paper in FIGS. 4 to 6 and down or downward refers to a inward direction into the plane of the paper in FIGS. 4 to 6. Also in general, fore or forward refers to a direction toward the front of a shoe or other footwear, that is, a downward direction within the plane of the paper in FIGS. 4 to 6 and aft or rearward refers to a direction toward the rear of the shoe or other footwear, that is, an upward direction within the plane of the paper in FIGS. 4 to 6.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved footwear lace retainers disclosed herein. The following detailed discussion of various alternative and preferred embodiments will illustrate the general principles of the invention with reference to lace retainer for an athletic shoe. Other embodiments suitable for other applications will be apparent to those skilled in the art given the benefit of this disclosure. The present invention can be utilized with any type of footwear having laces.

Figure 1:
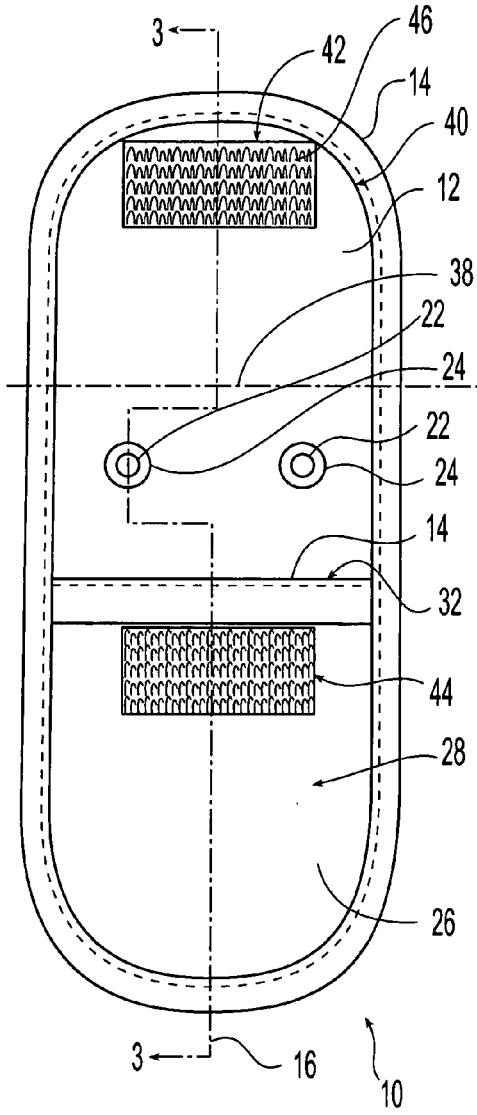
FIG. 1 is a front view of a footwear lace retainer according to the present invention.
Figure 2:
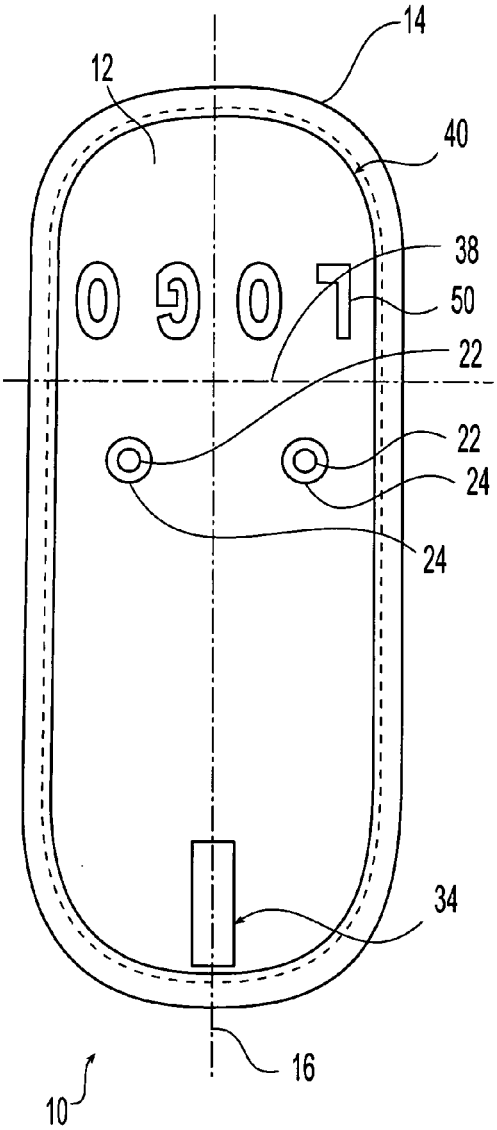
FIG. 2 is a rear view of the footwear lace retainer of FIG. 1.
Figure 3:
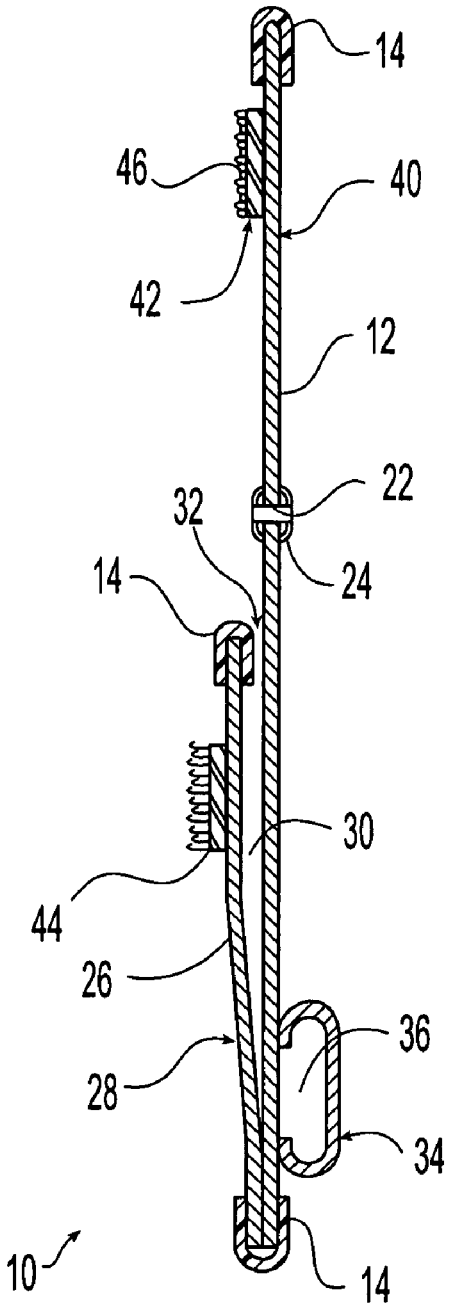
FIG. 3 is cross-sectional view taken along line 3—3 of FIG. 1.

Referring now to the drawings, FIGS. 1 to 3 illustrate a footwear or shoe lace retainer 10, that is a device for securing, concealing and containing ends of a lace of a shoe or a footwear, according to a preferred embodiment of the present invention. The illustrated lace retainer 10 includes a first or main wall or panel 12 which is preferably formed of a substantially flat and flexible sheet of material. The illustrated main panel 12 is formed of a sheet of cloth or fabric but it is noted that other suitable materials can alternatively be utilized. The illustrated main panel 12 is provided with binding strips 14 which are suitably stitched to the main panel 12 along the edge of the main panel 12 to prevent the edge from fraying. It is noted that other suitable means for preventing fraying of the edge can alternatively be utilized and/or the binding strips 14 can alternatively be attached in any other suitable manner. The illustrated main panel 12 is generally elongate having a length along a longitudinal axis 16 which is greater than a width generally perpendicular to the longitudinal axis 16. Side edges of the illustrated main panel 12 are substantially parallel while end edges are arcuate or "rounded". The main panel 12 is sized and shaped to cooperate with a shoe or other footwear 18 and lace 20 (best shown in FIGS. 4 to 6) as described in more detail hereinafter.

A pair of laterally spaced-apart openings 22 are provided at a central portion of the main panel 12 which extend entirely through the main panel 12. The openings 22 are sized and shaped for passage of ends of the lace 20 therethrough. The openings 22 are spaced-apart a distance adequate for tying the ends of the lace 20 passing therethrough in a bow knot or other suitable manner as described in more detail hereinafter. The illustrated openings 22 are provided with grommets 24 to prevent the edge of the main panel 12 from fraying. It is noted that other suitable means for preventing fraying of the edge can alternatively be utilized. It is noted that other quantities of openings 22 can alternatively be utilized such as, for example, a single oblong or oval slot or the like.

Figure 7:
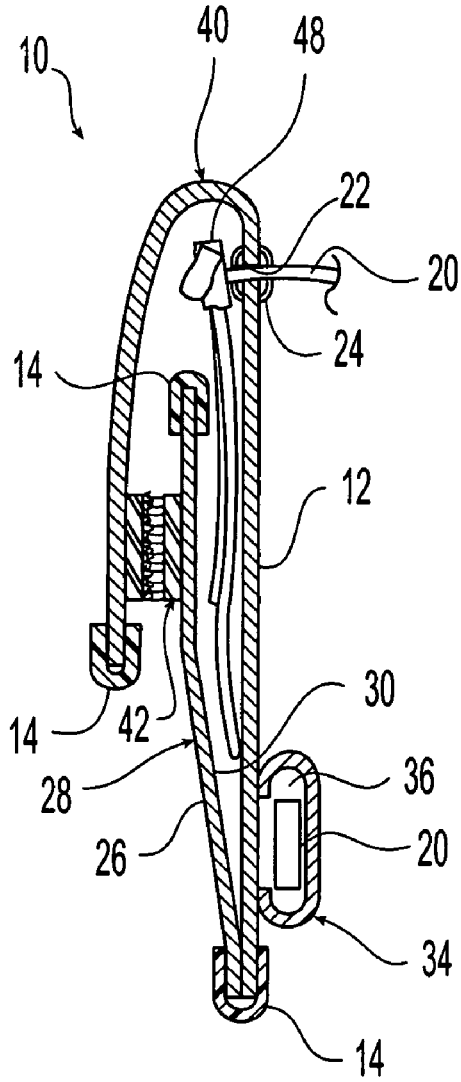
FIG. 7 is a cross-sectional view of the installed footwear lace retainer taken along line 7—7 of FIG. 6.

A second or pocket wall or panel 26 is secured to the lower end (as viewed in FIGS. 1 to 3) of the main panel 12 to form a pocket 28 having substantially closed interior space 30 (best shown in FIG. 7). The illustrated pocket 28 is entirely closed except an open upper end 32 (as viewed in FIGS. 1 to 3) facing the openings 22. The pocket panel 26 is preferably formed of the same material as the main panel 12, that is, a substantially flat and flexible sheet of material. The illustrated pocket panel 26 is formed of a sheet of cloth or fabric but it is noted that other suitable materials can alternatively be utilized. The illustrated pocket panel 26 is provided with binding strips 14 which are suitably stitched to the pocket panel 26 along the edges of the pocket panel 26 to prevent edges from fraying. Some of the illustrated binding strips 14 are shared with the main panel 12 to protect edges of both the main panel 12 and the pocket panel 26. It is noted that other suitable means for preventing fraying of the edges can alternatively be utilized and/or the binding strips 14 can alternatively be attached in any other suitable manner. The illustrated pocket panel 26 is secured to the main panel 12 by stitching but any other suitable securing means can alternatively be utilized. The pocket panel 26 is sized and shaped so that the pocket 28 holds and conceals the ends of the lace 20, loops of the lace 20, or any other desired portion of the lace 20 therein as described in more detail hereinafter. It is noted that the pocket panel 26 can be an integral portion of the main panel 12, that is, the main and pocket panels 12, 26 can alternatively be formed by a folded sheet.

The illustrated lace retainer 10 is provided with an attachment 34 for removably securing the lower end (as viewed in FIGS. 1 to 3) of the lace retainer 10 to the shoe 18 and or the lace 20. The attachment 34 of illustrated lace retainer 10 is a loop forming a laterally extending opening 36 sized, shaped, and oriented so that the lace 20 can pass through at least one time to secure the lace retainer 10 to the shoe 18. Preferably, the loop 34 is sized so that the lace 20 can extend therethrough at least two times. It is noted that alternatively other suitable attachment 34 can be utilized such as for example, a pair of spaced apart openings or slits in the main panel. The illustrated attachment 34 is located on the rear side of the main panel 12 opposite the pocket 28 near the lower end (as viewed in FIGS. 1 to 3) of the main panel 12. The attachment 34 is preferably formed of the same material as the main panel 12 and the pocket panel 26, that is, a substantially flat and flexible sheet of material. The illustrated attachment 34 is formed of a sheet of cloth or fabric but it is noted that other suitable materials can alternatively be utilized. The illustrated attachment 34 is secured to the main panel 12 by stitching but any other suitable securing means can alternatively be utilized.

The illustrated main panel 12 is flexible so that a laterally extending fold line 38 is formed in the main panel 12 above the openings 22 so that the upper portion of the main panel 12 forms a flap or closure 40 which can be pivoted about the fold line 38 between an opening position for providing access to the upper open end 32 of the pocket 38 and a closing position for closing the upper open end 32 of the pocket 38. It is noted that any other suitable closure 40 can alternatively be utilized such as, for example, a separate cover and that any other suitable means for pivoting the closure 40 can alternatively be utilized such as, for example, a hinge or living hinge.

The illustrated closure 40 is provided with a fastener 42 for releasably securing the closure 40 in the closing position.

The illustrated fastener 42 is a hook-and-loop type fastener such as, for example, VELCRO®. It is noted that alternatively any other suitable fastener 42 can be utilized such as, for example, buttons, snaps, hooks, straps, elastic or resilient bands, ties, or the like. The lustrated fastener 42 includes of strip of hook material 44 located on a front or outer side of the pocket panel 26 (as viewed in FIGS. 1 to 3) near the open end 32 of the pocket 28 and a strip of loop or pile material 46 located on a front side of the main panel 12 near the top of the main panel 12 (as viewed in FIGS. 1 to 3) so that it is located on the closure 40. It is noted that the position of the strips of hook material and loop material 44, 46 can alternatively be reversed. The illustrated fastener 42 is secured to the main panel 12 and the pocket panel 26 by stitching but alternatively any other suitable securing means can be utilized.

Figure 6:
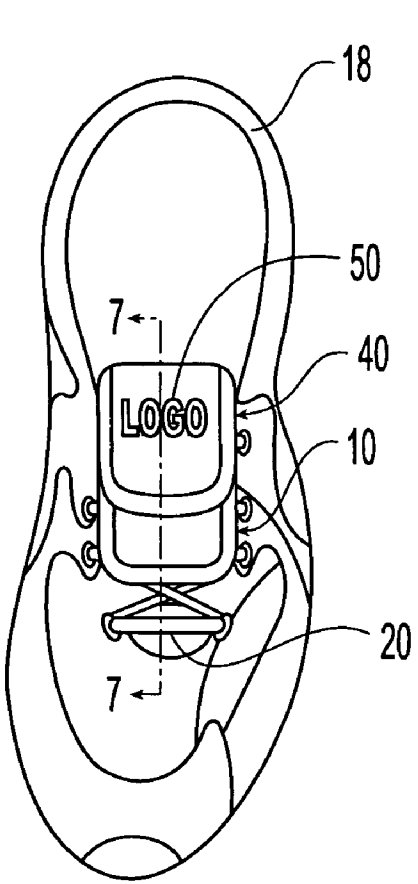
FIG. 6 is a top view showing the footwear lace retainer of FIGS. 1 to 3 in a fully installed condition wherein the lace is tied in a bow knot, inserted into the pocket, and secured in the pocket by a closure of the footwear lace retainer.

As best shown in FIGS. 2 and 6, the retainer 10 can be provided with desired indicia or decorations 50. The indicia 50 can include alphanumeric characters such as, for example, a team name, a player number, a player name, or the like. The indicia 50 can also include a graphic symbol or logo such as, for example, a team or company logo, a decorative graphic, or the like. The indicia 50 is preferably located on an exterior surface of the retainer 10. The illustrated indicia 50 is located on the exterior surface of the closure 40 but other suitable locations can alternatively be utilized. The indicia 50 can be provided directly on the retainer 10 by any suitable means such as, for example printing, embroidery, or the like, can be permanently secured to the retainer 10, by any suitable means such as, for example, a sewn patch, a bonded patch, or the like, or can be removably secured to the retainer 10 by any suitable means such as, for example, a patch secured by snaps, a patch secured by hook and loop fastener, or the like.

Figure 5:
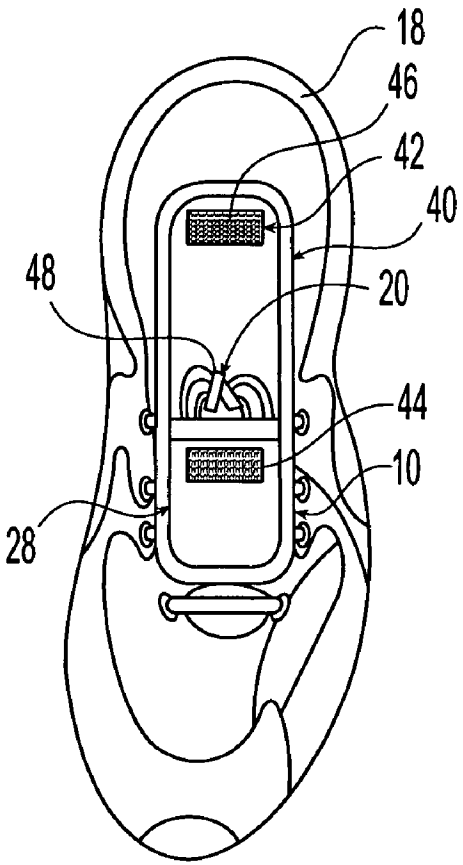
FIG. 5 is a top view showing the footwear lace retainer of FIGS. 1 to 3 in a partially installed condition wherein the lace is tied in a bow knot and inserted into a pocket of the footwear lace retainer.

Installation of the lace retainer 10 onto the shoe 18 is best shown in FIGS. 4 to 7. The lace retainer 10 is positioned above the lace area of the shoe 18 and the lace 20 is fed through the attachment 34 as the shoe 18 is laced. Once the shoe 18 is laced, the ends of the lace 20 are fed through the openings 22 in the main panel 12 and are tied in a bow knot 48 or other suitable manner above the main panel 12. As best shown in FIG. 5, The ends of the lace 20, the loops of the bow knot 48, and any other loose portions of the lace 20 are inserted into the pocket 28 through the upper open end 32 of the pocket 28. As best shown in FIGS. 6 and 7, the closure 40 is pivoted about the fold line 38 to close the upper open end 32 of the pocket 28 and the fastener 42 is secured so that the closure 40 remains in its closing position. Once installed, all free or loose portions of the lace 20 are located within the pocket 28 and secured and concealed by the closure 40. Contained and sealed in this manner, the lace 20 cannot easily fall or slip out of the lace retainer 10 during use.

From the above description, it should be appreciated that the present invention provides a lace retainer 10 and method of retaining a lace which is relatively simple and inexpensive to produce is versatile, convenient, effective, and/or safe for use in sporting events.

From the foregoing disclosure and detailed description of certain preferred embodiments, it will be apparent that various modifications, additions and other alternative embodiments are possible without departing from the true scope and spirit of the present invention. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A footwear lace retainer comprising, in combination:

a first wall having at least one opening for passage of the lace therethrough;

a second wall operatively connected to the first wall to form a pocket sized and shaped for receiving ends of the lace therein and having an open end facing toward the opening;

wherein the pocket forms an interior space entirely closed except for the open end facing toward the opening;

a closure selectively movable between a closing position wherein the open end of the pocket is closed with the ends of the lace within the pocket and an opening position wherein the open end of the pocket is open; and a fastener releasably securing the closure in the closing position.

2. The footwear lace retainer according to claim 1, wherein the first and second walls each comprise a flexible sheet.

3. The footwear lace retainer according to claim 2, wherein the first and second walls each comprise fabric.

4. The footwear lace retainer according to claim 3, wherein edges of the first and second walls are each provided with binding strips.

5. The footwear lace retainer according to claim 1, wherein the fastener is a hook and loop fastener.

6. The footwear lace retainer according to claim 1, wherein the closure is an integral extension of the first wall.

7. The footwear lace retainer according to claim 6, wherein the first wall and the closure each comprise fabric and the closure is foldable between the closing and opening positions about a fold line.

8. The footwear lace retainer according to claim 1, wherein the opening is provided with a grommet.

9. The footwear lace retainer according to claim 1, further comprising an attachment on the first wall opposite the pocket for securing the first wall to the lace.

10. The footwear lace retainer according to claim 9, wherein the attachment comprises a loop for passage of the lace therethrough.

11. A footwear lace retainer comprising, in combination:

a first fabric sheet having at least one opening for passage of the lace therethrough;

a second fabric sheet secured to the first fabric sheet to form a pocket sized and shaped for receiving ends of the lace therein and having an open end facing toward the opening;

wherein a portion of the first fabric sheet forms a closure selectively foldable between a closing position wherein the open end of the pocket is closed with the ends of the lace within the pocket and an opening position wherein the open end of the pocket is open;

wherein a fold line of the first fabric sheet forming the closure is spaced-apart from the pocket with the opening located outside the pocket and between the open end of the pocket and the fold line so that the closure folds over the opening and toward the pocket when in the closing position; and a fastener releasably securing the closure in the closing position.

12. The footwear lace retainer according to claim 11, wherein the fastener is a hook and loop fastener.

13. The footwear lace retainer according to claim 11, wherein the opening is provided with a grommet.

14. The footwear lace retainer according to claim 11, wherein the pocket forms an interior space entirely closed except for the open end facing toward the opening.

15. The footwear lace retainer according to claim 11, further comprising an attachment on the first fabric sheet opposite the pocket for securing the first fabric sheet to the lace.

16. The footwear lace retainer according to claim 15, wherein the attachment comprises a loop for passage of the lace therethrough.

17. The footwear lace retainer according to claim 11, wherein edges of the first and second fabric sheets are each provided with binding strips.

18. A footwear lace retainer comprising, in combination:

a first fabric sheet having a pair of spaced-apart openings for passage of the lace therethrough;

a second fabric sheet secured to the first fabric sheet to form a pocket sized and shaped for receiving ends of the lace therein and having an open end facing toward the openings;

wherein the pocket forms an interior space entirely closed except for the open end facing toward the opening;

wherein a portion of the first fabric sheet forms a closure selectively foldable between a closing position wherein the open end of the pocket is closed with the ends of the lace within the pocket and an opening position wherein the open end of the pocket is open;

wherein the openings are located outside of the pocket and between a fold line of the first fabric sheet and the open end of the pocket;

a hook and loop fastener releasably securing the closure in the closing position; and an attachment on the first fabric sheet opposite the pocket for securing the first fabric sheet to the lace.

19. The footwear lace retainer according to claim 18, wherein the attachment comprises a loop for passage of the lace therethrough.

* * * * *